US006334640B1

(12) United States Patent
Werner et al.

(10) Patent No.: US 6,334,640 B1
(45) Date of Patent: Jan. 1, 2002

(54) SNOW SHOVEL SYSTEM

(76) Inventors: August A. Werner, 2718 Berkshire Dr., Bismarck, ND (US) 58501; Robert J. Jahner; Donald M. Jahner, both of 7873 Highway 83, Linton, ND (US) 58552

( * ) Notice: Subject to any disclaimer, the term of this patent is extended or adjusted under 35 U.S.C. 154(b) by 0 days.

(21) Appl. No.: 09/676,285

(22) Filed: Sep. 28, 2000

(51) Int. Cl.[7] ..... E01H 5/02
(52) U.S. Cl. ..... 294/54.5; 37/265; 37/285
(58) Field of Search ..... 294/54.5, 57; 37/265, 37/230, 279, 284, 285; D15/11

(56) References Cited

U.S. PATENT DOCUMENTS

| | | | | | |
|---|---|---|---|---|---|
| 1,415,979 | A | | 5/1922 | Bedford | 37/282 |
| 1,534,179 | A | | 4/1925 | Klinger | 37/282 |
| 1,956,295 | A | * | 4/1934 | Lindgren | 37/284 |
| 2,441,449 | A | | 5/1948 | Shaw | 37/282 |
| 2,508,612 | A | * | 5/1950 | Kimbler | 37/284 |
| 2,513,230 | A | * | 6/1950 | Bourne et al. | 37/284 |
| 2,715,786 | A | * | 8/1955 | Dorko | 37/284 |
| 2,811,792 | A | * | 11/1957 | Cork, Jr. | 37/284 |
| 2,852,872 | A | * | 9/1958 | Benz | 294/57 |
| 2,863,232 | A | * | 12/1958 | Steinbach et al. | 37/284 |
| D190,820 | S | * | 7/1961 | O'Connor | D15/11 |
| 3,643,356 | A | * | 2/1972 | Gohl | 294/54.5 |
| 3,748,761 | A | * | 7/1973 | Chetwynde | 294/54.5 |
| 3,810,320 | A | | 5/1974 | Siebert | 37/46 |
| 4,179,828 | A | * | 12/1979 | Brunty | 37/265 |
| 4,199,181 | A | | 4/1980 | Mason | 294/54 |
| 4,214,385 | A | * | 7/1980 | Baranowski et al. | 294/54.5 |
| 4,224,751 | A | * | 9/1980 | Schoemann et al. | 37/265 |
| 4,865,373 | A | | 9/1989 | Hudson | 294/54.5 |
| 4,910,893 | A | | 3/1990 | Asay | 37/281 |
| 5,048,206 | A | * | 9/1991 | Jones | 37/265 |
| 5,493,797 | A | | 2/1996 | Jackson | 37/285 |
| 5,509,219 | A | * | 4/1996 | Mecca | 37/279 |
| 5,511,327 | A | * | 4/1996 | Jurowski et al. | 294/54.5 |
| 5,581,915 | A | * | 12/1996 | Lobato | 37/285 |
| 5,669,163 | A | * | 9/1997 | Winter | 37/284 |

FOREIGN PATENT DOCUMENTS

| | | | | |
|---|---|---|---|---|
| CA | 457100 | * | 5/1949 | 37/284 |
| FR | 2692296 | * | 12/1993 | 37/284 |

* cited by examiner

*Primary Examiner*—Eileen D. Lillis
*Assistant Examiner*—Paul T. Chin

(57) ABSTRACT

A snow shovel system for easily removing snow from a surface without requiring significant physical effort by a user. The snow shovel system includes a blade member having a first edge and a second edge, a frame attached to a rear surface of the blade member, a handle pivotally attached to the frame, and a wheel rotatably attached to the frame for maintaining the blade member in a substantially horizontal position. The handle may be rotated approximately 180 degrees with respect to the blade member for allowing the user to select which edge of the blade member will be utilized to engage the surface to be cleaned of snow which determines whether the snow is pushed to the left side or right side of the user during a forward movement.

1 Claim, 7 Drawing Sheets

SNOW SHOVEL SYSTEM

BACKGROUND OF THE INVENTION

1. Field of the Invention

The present invention relates generally to snow shovels and more specifically it relates to a snow shovel system for easily removing snow from a surface without requiring significant physical effort by a user.

2. Description of the Prior Art

Snow shovels have been in use for years. Typically, a conventional snow shovel is comprised of a handle with a broad scoop portion attached to the end of the handle. To utilize a conventional snow shovel the user first must insert the scoop portion into a pile of snow and then physically elevate the scoop which requires significant physical exertion. Utilizing a conventional snow shovel applies significant pressures and forces to the back of the user. In addition, many individuals in poor physical health often times become injured as a result of the significant physical requirements to utilize a conventional snow shovel.

Examples of patented snow shovel devices which are illustrative of such prior art include U.S. Pat. No. 1,415,979 to Bedford; U.S. Pat. No. 1,534,179 to Klinger; U.S. Pat. No. 2,441,449 to Shaw; U.S. Pat. No. 3,810,320 to Siebert; U.S. Pat. No. 4,910,893 to Asay; U.S. Pat. No. 5,493,797 to Jackson; U.S. Pat. No. 4,865,373 to Hudson; U.S. Pat. No. 4,199,181 to Mason.

While these devices may be suitable for the particular purpose to which they address, they are not as suitable for easily removing snow from a surface without requiring significant physical effort by a user. Conventional snow shovel devices require an individual to exert significant physical forces which are not desirable.

In these respects, the snow shovel system according to the present invention substantially departs from the conventional concepts and designs of the prior art, and in so doing provides an apparatus primarily developed for the purpose of easily removing snow from a surface without requiring significant physical effort by a user.

SUMMARY OF THE INVENTION

In view of the foregoing disadvantages inherent in the known types of snow shovels now present in the prior art, the present invention provides a new snow shovel system construction wherein the same can be utilized for easily removing snow from a surface without requiring significant physical effort by a user.

The general purpose of the present invention, which will be described subsequently in greater detail, is to provide a new snow shovel system that has many of the advantages of the snow shovels mentioned heretofore and many novel features that result in a new snow shovel system which is not anticipated, rendered obvious, suggested, or even implied by any of the prior art snow shovels, either alone or in any combination thereof.

To attain this, the present invention generally comprises a blade member having a first edge and a second edge, a frame attached to a rear surface of the blade member, a handle pivotally attached to the frame, and one or more wheels rotatably attached to the frame for maintaining the blade member in a substantially horizontal position. The handle may be rotated approximately 180 degrees with respect to the blade member for allowing the user to select which edge of the blade member will be utilized to engage the surface to be cleaned of snow which determines whether the snow is pushed to the left side or right side of the user during a forward movement.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a snow shovel system that will overcome the shortcomings of the prior art devices.

A second object is to provide a snow shovel system for easily removing snow from a surface without requiring significant physical effort by a user.

Another object is to provide a snow shovel system that does not require the user to elevate the shovel or snow to remove snow from a surface.

An additional object is to provide a snow shovel system that can be utilized upon various surfaces such as but not limited to sidewalks, driveways, streets and other surfaces.

A further object is to provide a snow shovel system that easily allows the user to create and manipulate a windrow of snow to push to one side of a surface.

Another object is to provide a snow shovel system that allows the user to push snow to either their left side or right side during a forward movement.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
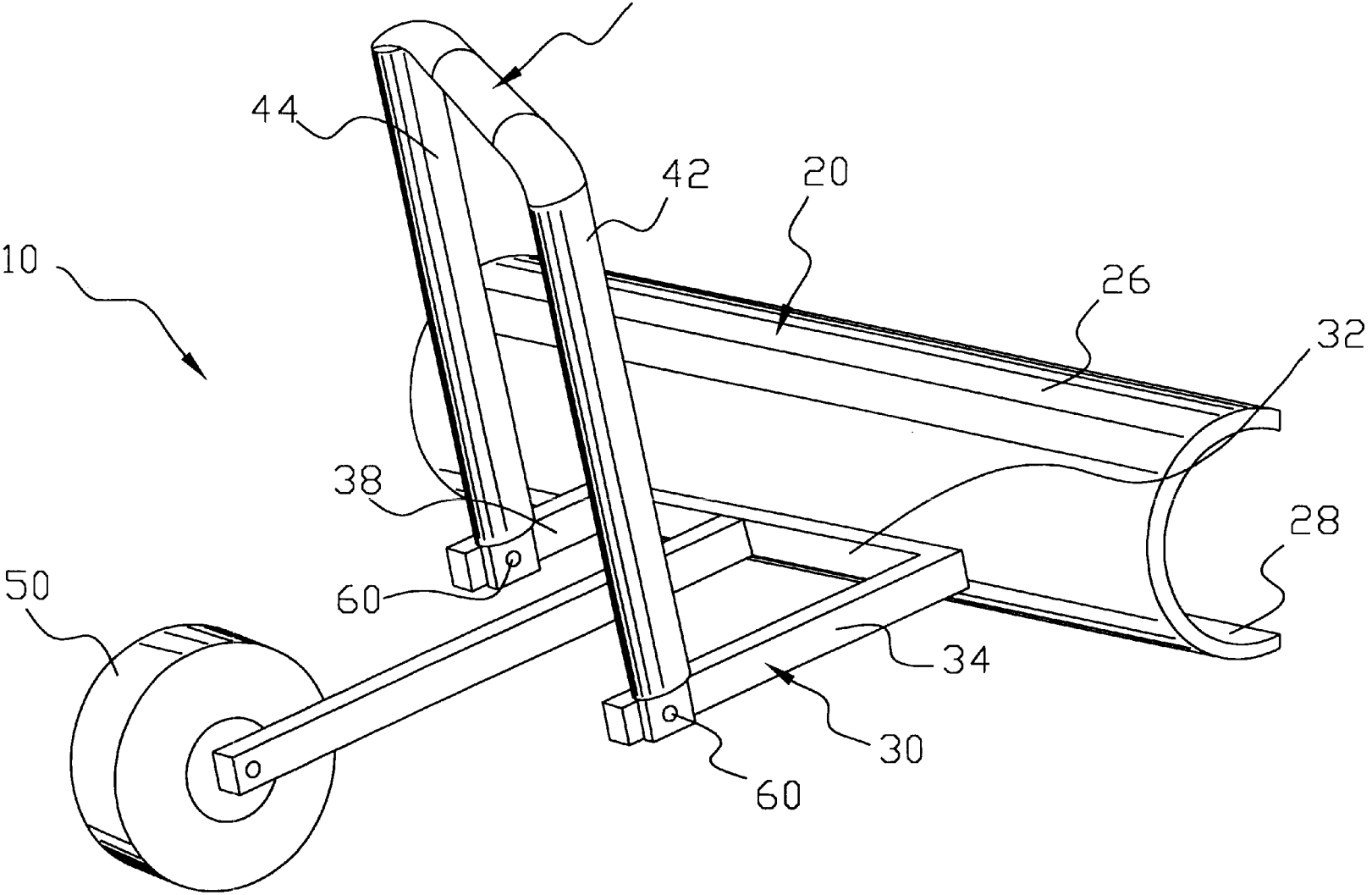
FIG. 1 is a rear upper perspective view of the present invention.

Turning now descriptively to the drawings, in which similar reference characters denote similar elements throughout the several views, FIGS. 1 through 7 illustrate a snow shovel system 10, which comprises a blade member 20 having a first edge 22 and a second edge 24, a frame 30 attached to a rear surface 26 of the blade member 20, a handle 40 pivotally attached to the frame 30, and one or more wheels 50 rotatably attached to the frame 30 for maintaining the blade member 20 in a substantially horizontal position. The handle 40 may be rotated approximately 180 degrees with respect to the blade member 20 for allowing the user to select which edge of the blade member 20 will be utilized to engage the surface to be cleaned of snow which determines whether the snow is pushed to the left side or right side of the user during a forward movement.

As shown in FIGS. 1 through 7 of the drawings, the blade member 20 is an elongated structure. As best shown in FIGS. 1, 3, 5, 6 and 7 of the drawings, the blade member 20 preferably is curved having a C-shape however various other shapes may be utilized to construct the blade member 20. The blade member 20 is preferably constructed of a rigid material such as but not limited to plastic or metal. The blade member 20 includes a rear surface 26 and a front surface 28 wherein the front surface 28 engages the snow to be removed from the surface.

Figure 2:
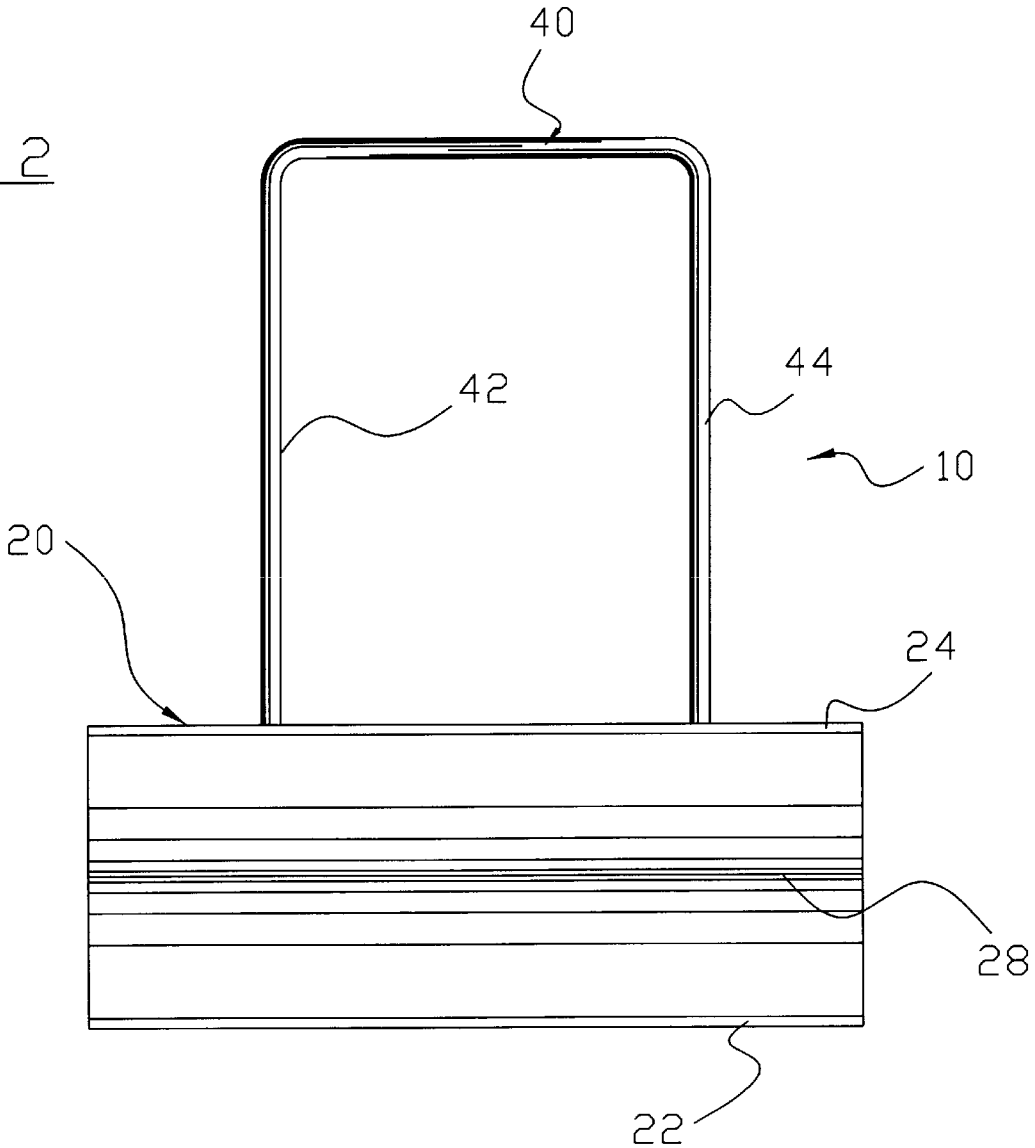
FIG. 2 is a front view of the present invention.
Figure 3:
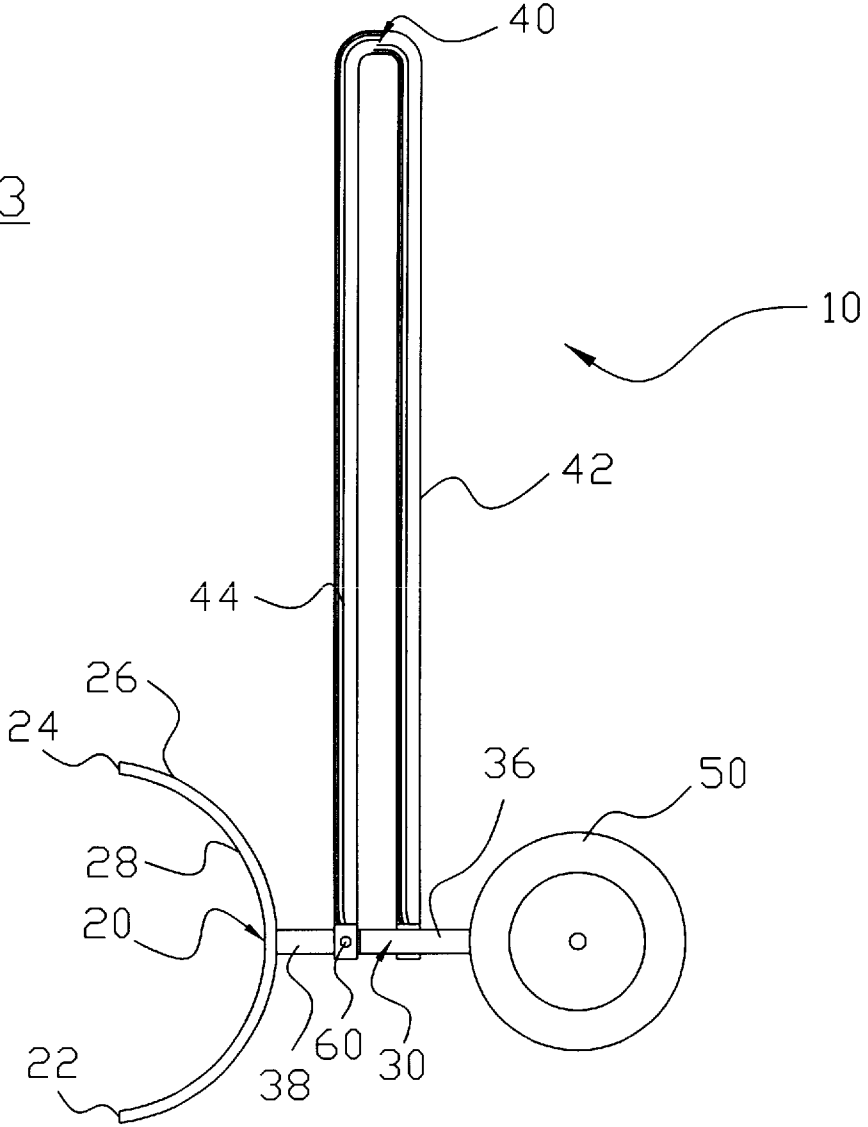
FIG. 3 is a left side view of the present invention.
Figure 7:
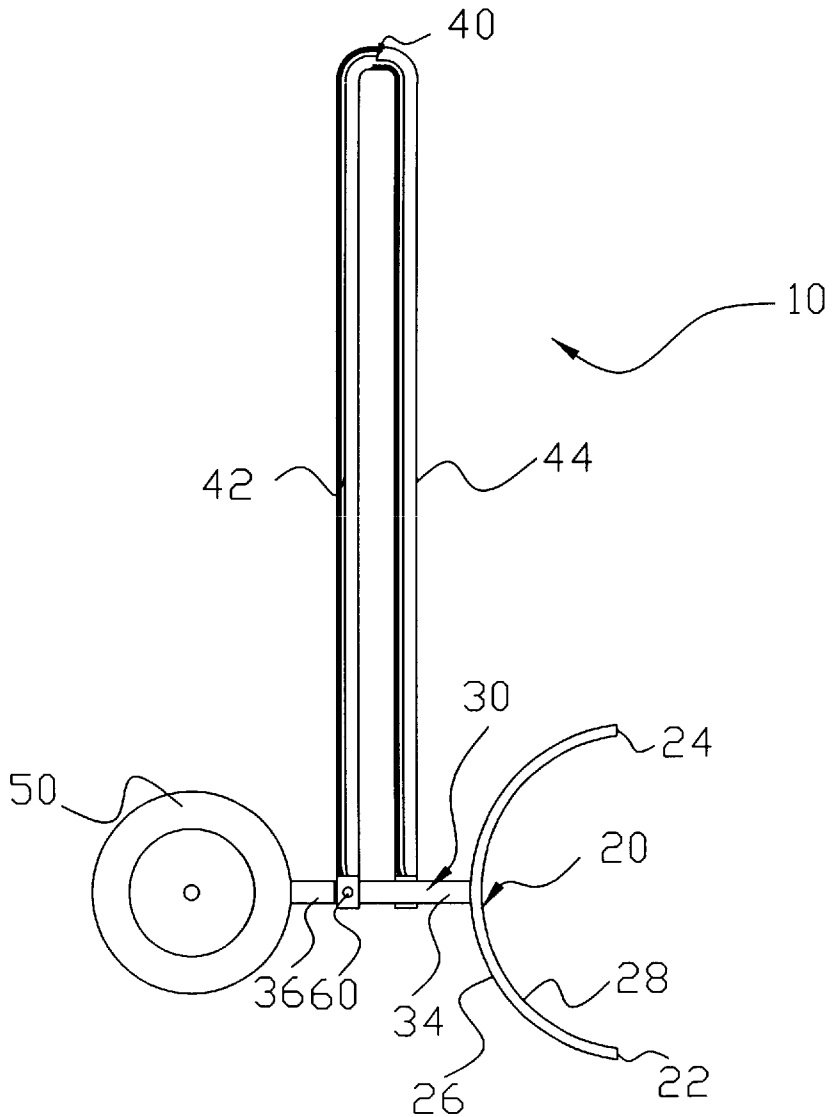
FIG. 7 is a right side view of the present invention

As shown in FIGS. 1 and 2 of the drawings, the blade member 20 has a first edge 22 and a second edge 24 opposite of the first edge 22. The first edge 22 engages the surface being cleaned of snow when the snow shovel system 10 is within a "first position" as best shown in FIGS. 3 and 7 of the drawings. When the snow shovel system 10 is within a "second position" the second edge 24 of the blade member 20 engages the surface being cleaned of snow. The first edge 22 and the second edge 24 may be tapered and/or include a hardened metal portion to engage the surface being cleaned.

Figure 4:
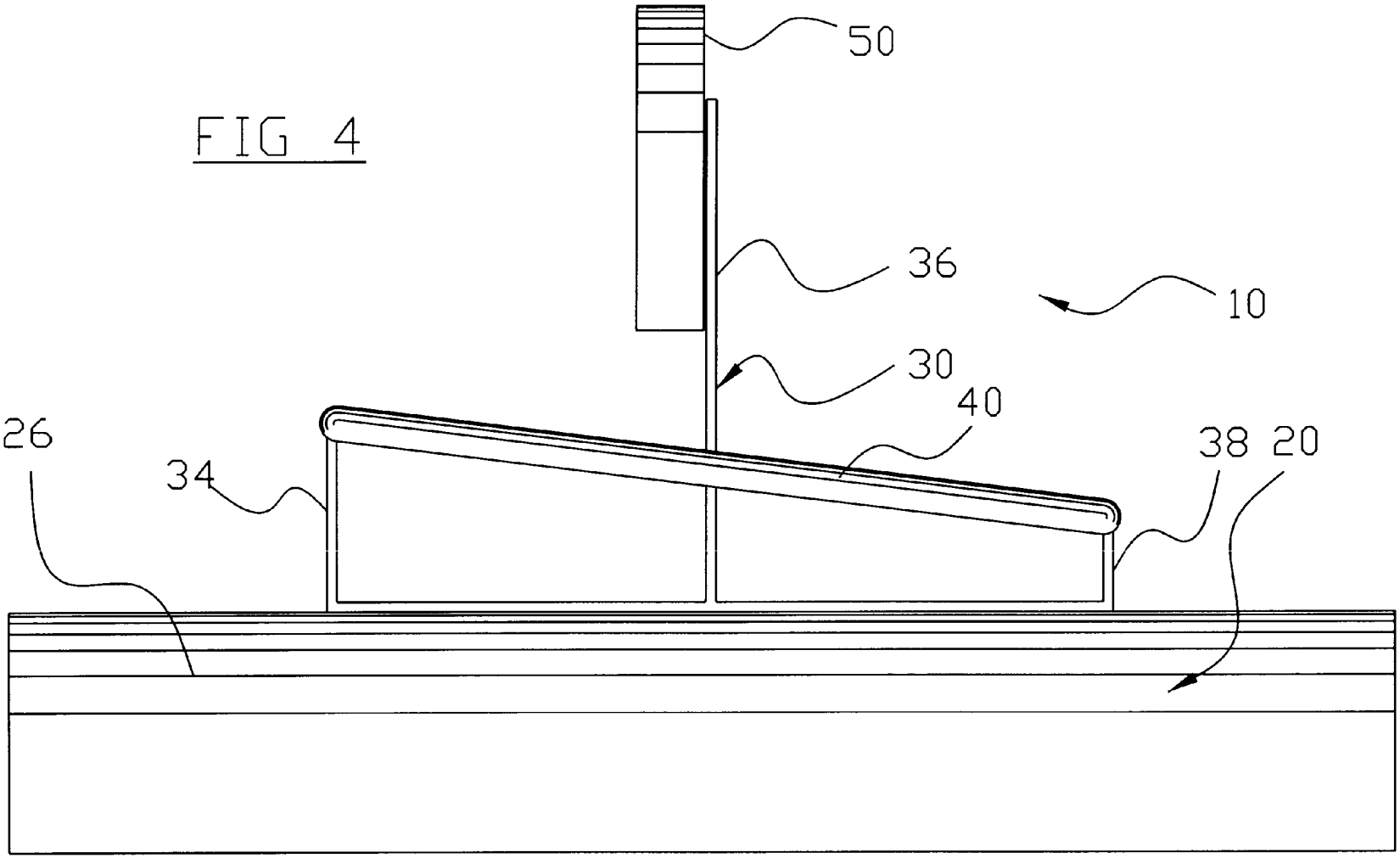
FIG. 4 is a top view of the present invention.
Figure 5:
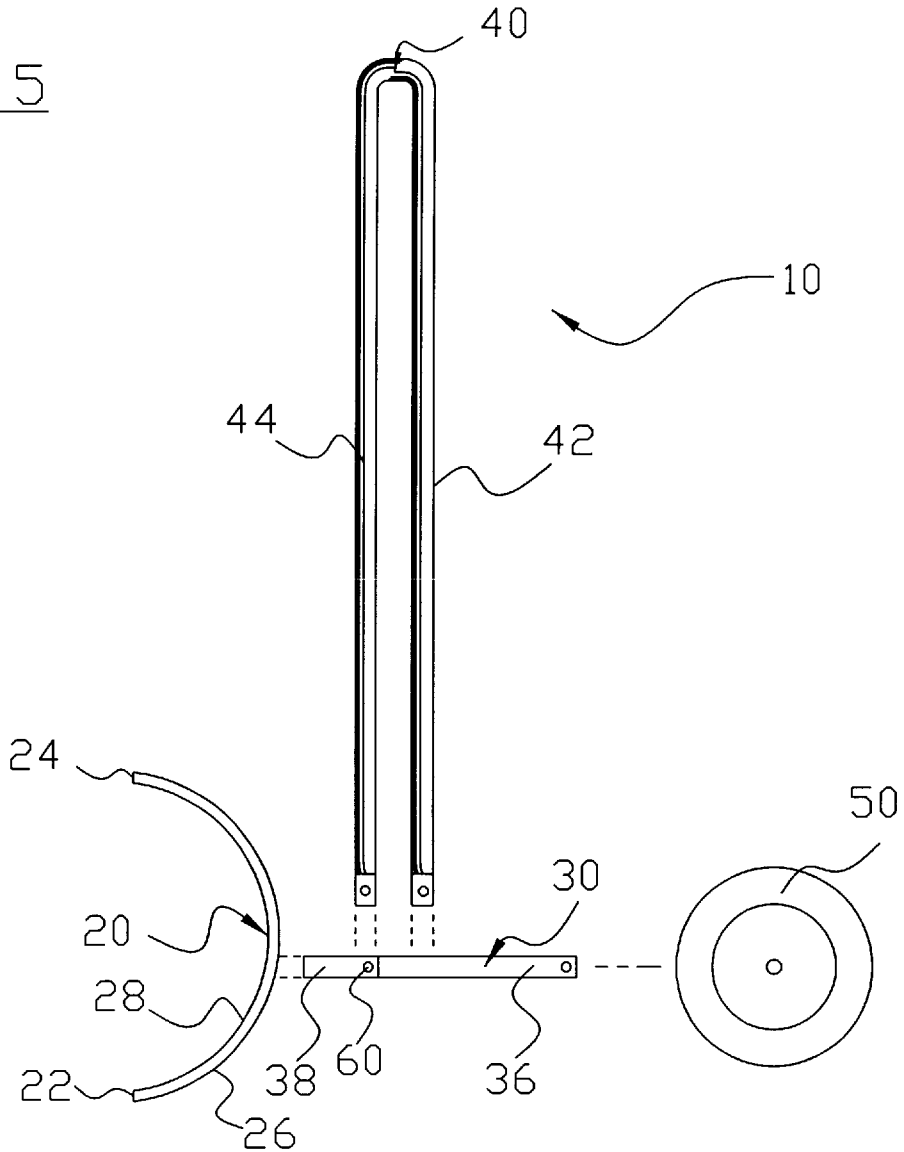
FIG. 5 is an exploded side view of the present invention.

As shown in FIGS. 1, 3 and 4 of the drawings, a frame 30 is attached to the rear surface 26 of the blade member 20. The frame 30 is preferably attached centrally upon the rear surface 26 of the blade member 20 to allow the blade member 20 to be rotated 180 degrees. The frame 30 includes a base member 32, a first arm 34, a second arm 36 and a third arm 38.

The base member 32 is attached adjacent the rear surface 26 of the blade member 20 as best shown in FIG. 1 of the drawings. The arms 34, 36, 38 extend away from the base member 32 and the blade member 20 as further shown in FIG. 1 of the drawings. The third arm 38 is shorter in length than the first arm 34.

The second arm 36 is attached to the base member 32 between the first arm 34 and the third arm 38 as shown in FIGS. 1 and 4 of the drawings. The second arm 36 preferably extends outwardly past the first arm 34 and the third arm 38 as best shown in FIG. 4 of the drawings. At least one wheel 50 is rotatably attached to the distal end of the second arm 36 as best shown in FIGS. 1 and 3 of the drawing as to support the blade member 20 in a substantially vertical position. Each wheel 50 preferably has a rotational plane parallel to a forward movement of the blade member 20.

Figure 6:
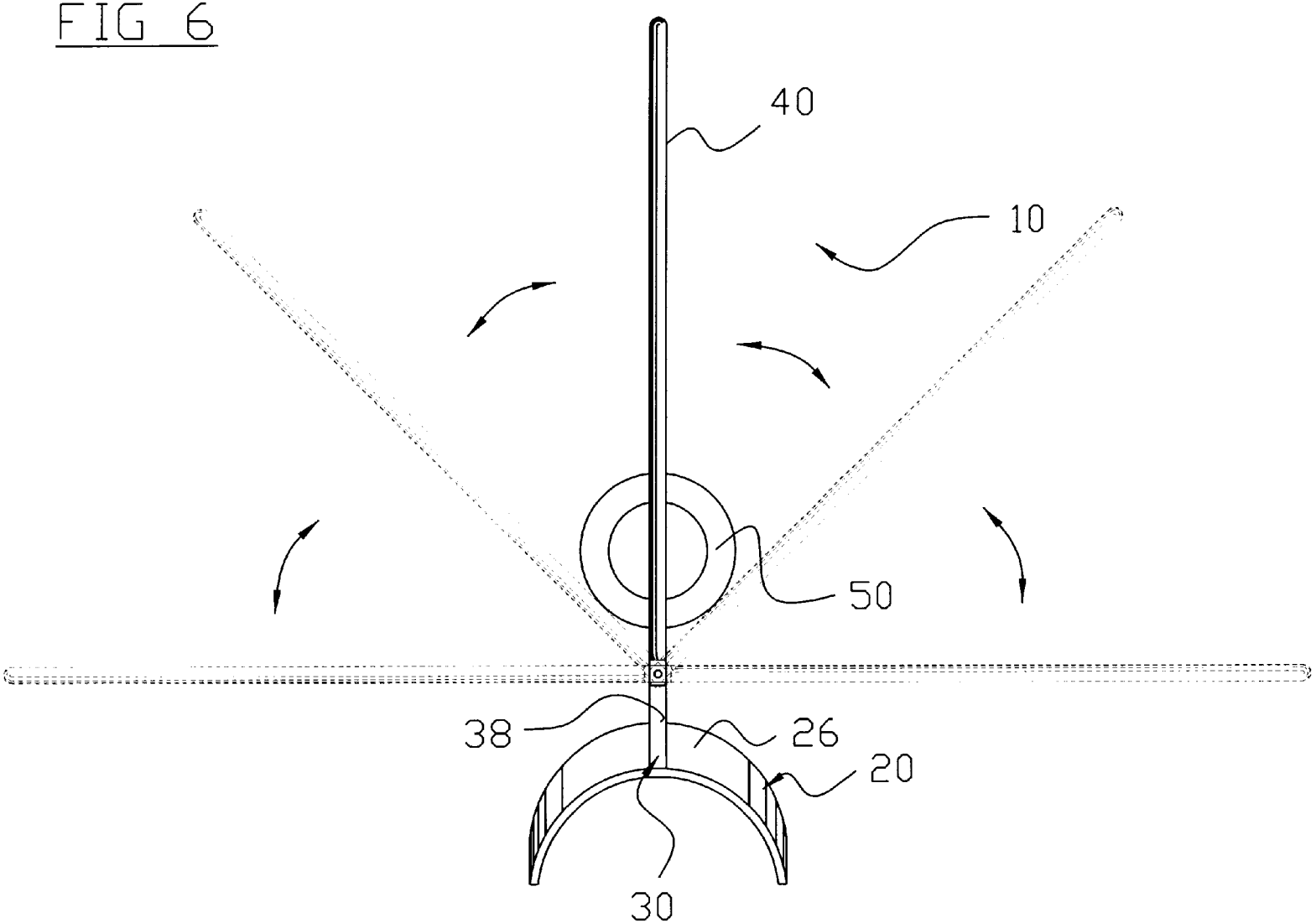
FIG. 6 is a side view of the present invention illustrating the 180 degree movement of the handle with respect to the blade member.

The handle 40 is pivotally attached to the frame 30 as best shown in FIGS. 1, 3 and 6 of the drawings. The handle 40 preferably includes a first pole 42 and a second pole 44 connected to one another at an upper portion. The lower distal ends of the first pole 42 and the second pole 44 are pivotally connected to the distal ends of the first arm 34 and the third arm 38 respectively as shown in FIG. 1 of the drawings. A pin 60 or other structure pivotally attaches the poles 42, 44 to the frame 30 as further shown in FIG. 1 of the drawings.

In use, the user positions the first edge 22 of the blade member 20 adjacent the surface to be cleaned thereby placing the snow shovel system 10 in the first position. The user then grasps the handle 40 and pushes the blade member 20 forwardly thereby diverting the snow into a windrow to the left side of the blade member 20. The wheels 50 provide rear support to the frame 30 and the blade member 20 thereby reducing the amount of wait applied to the handle 40 and for maintaining the blade member 20 in an upright position with respect to the surface. When the user reaches the end of the surface to be cleaned they rotate the blade member 20 approximately 180 degrees so that the second edge 24 is now adjacent the surface being cleaned of snow for the second position. The handle 40 is allowed to be extended upwardly with respect to the blade member 20 since the handle 40 is pivotally attached to the frame 30 secured to the blade member 20. The user then returns with the left side engaging the newly created windrow and the blade member 20 diverts the snow to the right side of the blade member 20. When the user reaches the opposing end of the surface being cleaned, the blade member 20 is rotated again into the first position. The above process is repeated until the surface is cleaned of snow as desired by the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A snow shovel system, comprising:

a blade member having a rear surface, a front surface, a first edge, and a second edge opposite of said first edge, wherein said blade member has a curved shape;

a frame attached to said rear surface of said blade member, wherein said frame comprises a base member attached to said rear surface of said blade member, a first arm extending from said base member, a third arm extending from said base member wherein said third arm is shorter in length than said first arm, and a second arm extending from said base member wherein said second arm is positioned between said first arm and said third arm and wherein said second arm is longer than said first arm;

a handle having a U-shaped structure, wherein said handle includes a first pole rotatably attached to a distal end of said first arm and a second pole rotatably attached said third arm, wherein said handle may be pivoted 180 degrees with respect to said blade member; and a wheel rotatably attached to a distal end of said second arm said frame for maintaining said blade member in an upright position, wherein said wheel has a rotational plane parallel to a forward path of said blade member.

* * * * *